US005810511A

United States Patent [19]

Schmidt

[11] Patent Number: 5,810,511

[45] Date of Patent: Sep. 22, 1998

[54] SPILL CONTAINMENT SYSTEM

[76] Inventor: Gordon G. Schmidt, 6824 - 94B Avenue, Edmonton, Alberta, Canada, T6B 0Z7

[21] Appl. No.: 544,992

[22] Filed: Oct. 30, 1995

[51] Int. Cl.[6] ..... E02D 27/32

[52] U.S. Cl. ..... 405/52; 405/303; 52/169.7

[58] Field of Search ..... 405/52, 270, 267, 405/278, 279, 303; 52/582.1, 264, 270, 284, 169.7; 137/303, 236.1

[56] References Cited

U.S. PATENT DOCUMENTS

| | | | |
|---|---|---|---|
| 2,490,272 | 12/1949 | Kascle | 52/169.7 X |
| 2,756,893 | 7/1956 | Barrere | 220/5 |
| 3,193,847 | 7/1965 | Mashura | 4/172 |
| 3,302,814 | 2/1967 | Dohner | 220/5 |
| 3,302,825 | 2/1967 | Schleeweiss | 220/67 |
| 3,835,605 | 9/1974 | Ueno | 52/169.7 |
| 3,854,269 | 12/1974 | Hancock | 52/754 |
| 4,223,498 | 9/1980 | Ventrice | 52/249 |
| 4,453,857 | 6/1984 | Serra et al. | 405/129 X |
| 4,483,641 | 11/1984 | Stoll | 405/129 |
| 4,554,190 | 11/1985 | McHenry et al. | 428/35 |
| 4,632,602 | 12/1986 | Hovnanian | 405/52 X |
| 4,762,440 | 8/1988 | Argandona | 137/363 X |
| 4,765,775 | 8/1988 | Kroger | 405/52 |
| 4,808,039 | 2/1989 | Fischer | 405/279 X |
| 4,818,151 | 4/1989 | Moreland | 405/303 |
| 4,917,537 | 4/1990 | Jacobson | 405/270 X |
| 4,978,249 | 12/1990 | Killman | 405/53 X |
| 4,981,762 | 1/1991 | Athey, Jr. | 428/594 |
| 5,012,944 | 5/1991 | Scheurenbrand et al. | 220/677 |
| 5,030,033 | 7/1991 | Heintzelman et al. | 405/52 X |
| 5,098,220 | 3/1992 | Norman | 405/52 |
| 5,354,149 | 10/1994 | Breaux | 405/128 |
| 5,360,293 | 11/1994 | Breaux et al. | 405/267 |

FOREIGN PATENT DOCUMENTS

| | | | |
|---|---|---|---|
| 1334680 | 9/1962 | Germany | 220/681 |
| 286068 | 10/1988 | Germany | 405/279 |
| 6247522 A | 9/1994 | Japan | 405/55 |

*Primary Examiner*—Tamara L. Graysay
*Assistant Examiner*—Frederick L. Lagman
*Attorney, Agent, or Firm*—Frank J. Dykas

[57] ABSTRACT

A spill containment system has plural fluid impervious sheets. Each sheet has peripheral edges adapted to sealingly couple to the peripheral edge of each other sheet. Plural wall elements each have an edge adapted to sealingly couple to, and uncouple from, peripheral edges of the fluid impervious sheets. The fluid impervious sheets and the wall elements may be sealed together to form a pan like structure.

15 Claims, 18 Drawing Sheets

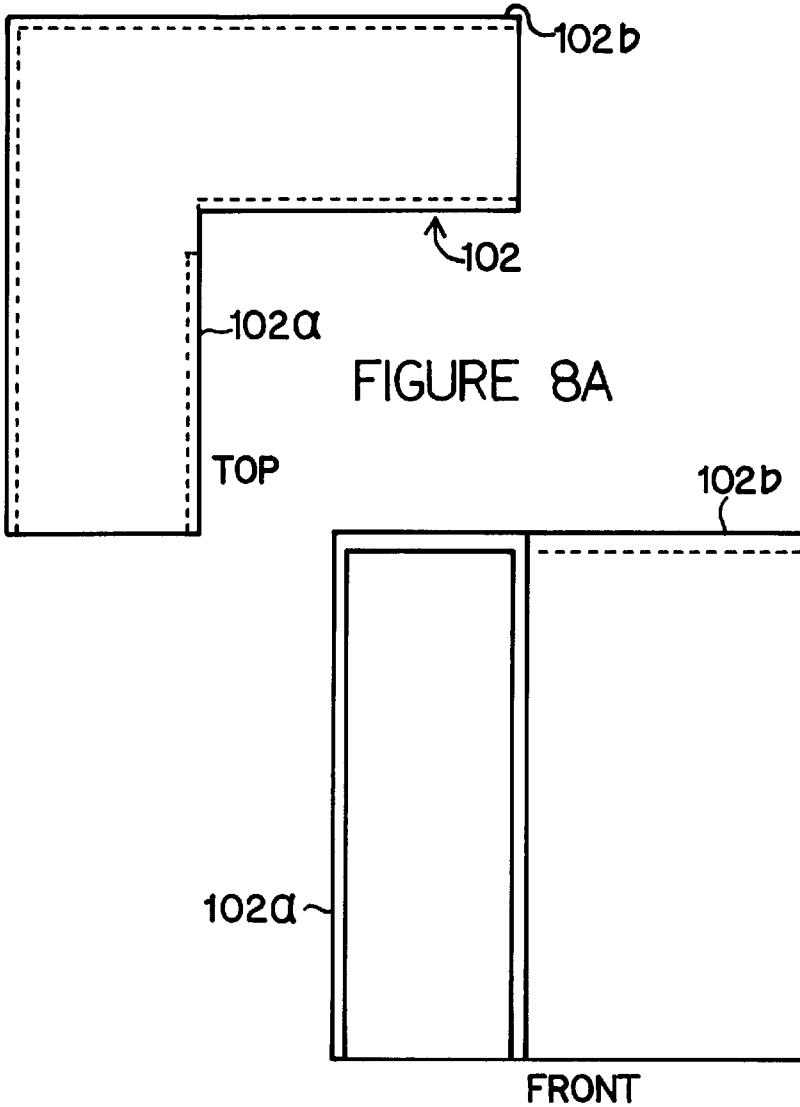
FIGURE 8A
FIGURE 8B
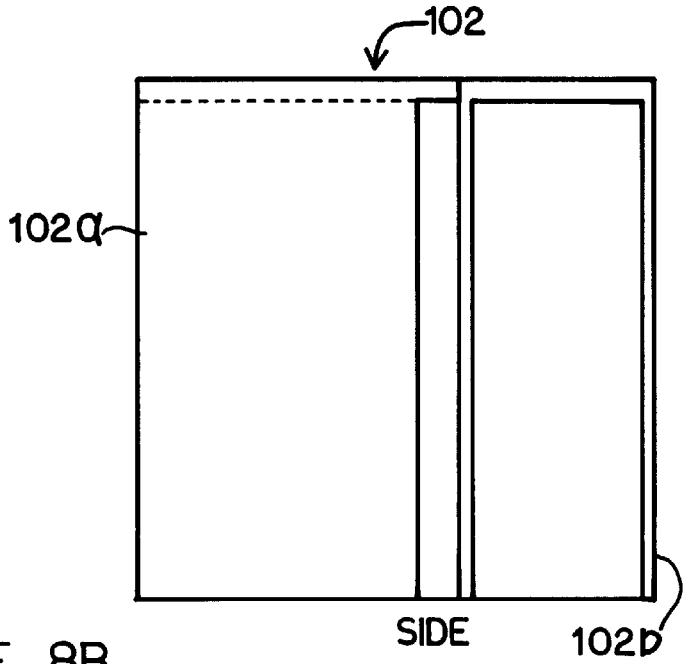
FIGURE 8C

SPILL CONTAINMENT SYSTEM

FIELD OF THE INVENTION

This invention relates to spill containment systems.

BACKGROUND OF THE INVENTION

Spill containment systems, as for example described in U.S. Pat. Nos. 5,098,220 of Norman, 4,765,775 of Kroger and 5,354,149 of Breaux, typically are formed of a single impermeable sheet or layer of clay that is formed around an object, such as a tank or oil well, that might spill environmentally hazardous fluids.

SUMMARY OF THE INVENTION

The inventor has identified that it would be desirable to have such a spill containment system for an oil well site, or other temporary location where spills of environmentally hazardous materials may occur, that may spread out over a wide area, and include considerably heavy equipment.

The inventor therefore proposes a modular spill containment system. Each module is formed of a fluid impervious sheet. Each sheet has peripheral edges adapted to sealingly couple to the peripheral edge of each other sheet. Plural wall elements each have an edge adapted to sealingly couple to, and uncouple from, peripheral edges of the fluid impervious sheets. The fluid impervious sheets and the wall elements may be sealed together to form a pan like structure.

In addition, the inventor has noted a need for an effective sealing system between fluid impervious sheets of a spill containment system or other barrier system.

The inventor therefore proposes an impervious sheet module for use in an extensive fluid barrier. The impervious sheet module includes a fluid impervious sheet having peripheral edges and corners between the peripheral edges. Each of the peripheral edges of the sheet includes a sealable coupling member sealed to the sheet, the sealable coupling member extending continuously along the peripheral edges of the sheet between the corners of the sheet. The sealable coupling member forms in cross-section a hook shape complimentary to itself so that the hook of one impervious sheet module may fit in the hook of another impervious sheet module. An expandable member may be placed between respective sealing edges of adjacent sheets to force the sealable coupling members into sealing relationship.

These and other aspects of the invention will now be described in more detail and claimed.

BRIEF DESCRIPTION OF THE DRAWINGS

There will now be described preferred embodiments of the invention, with reference to the drawings, by way of illustration, in which like numerals denote like elements and in which:

FIGS. 8A, 8B and 8C are respectively a top view, front view and side view of a connection-sealing mechanism for use at a corner of one of the fluid impervious sheet of FIG. 1;

FIG. 1OA is a detail of a corner where several fluid impervious sheets according to the invention meet and shows a seal for such a corner;

DETAILED DESCRIPTION OF PREFERRED EMBODIMENTS

Figure 1:
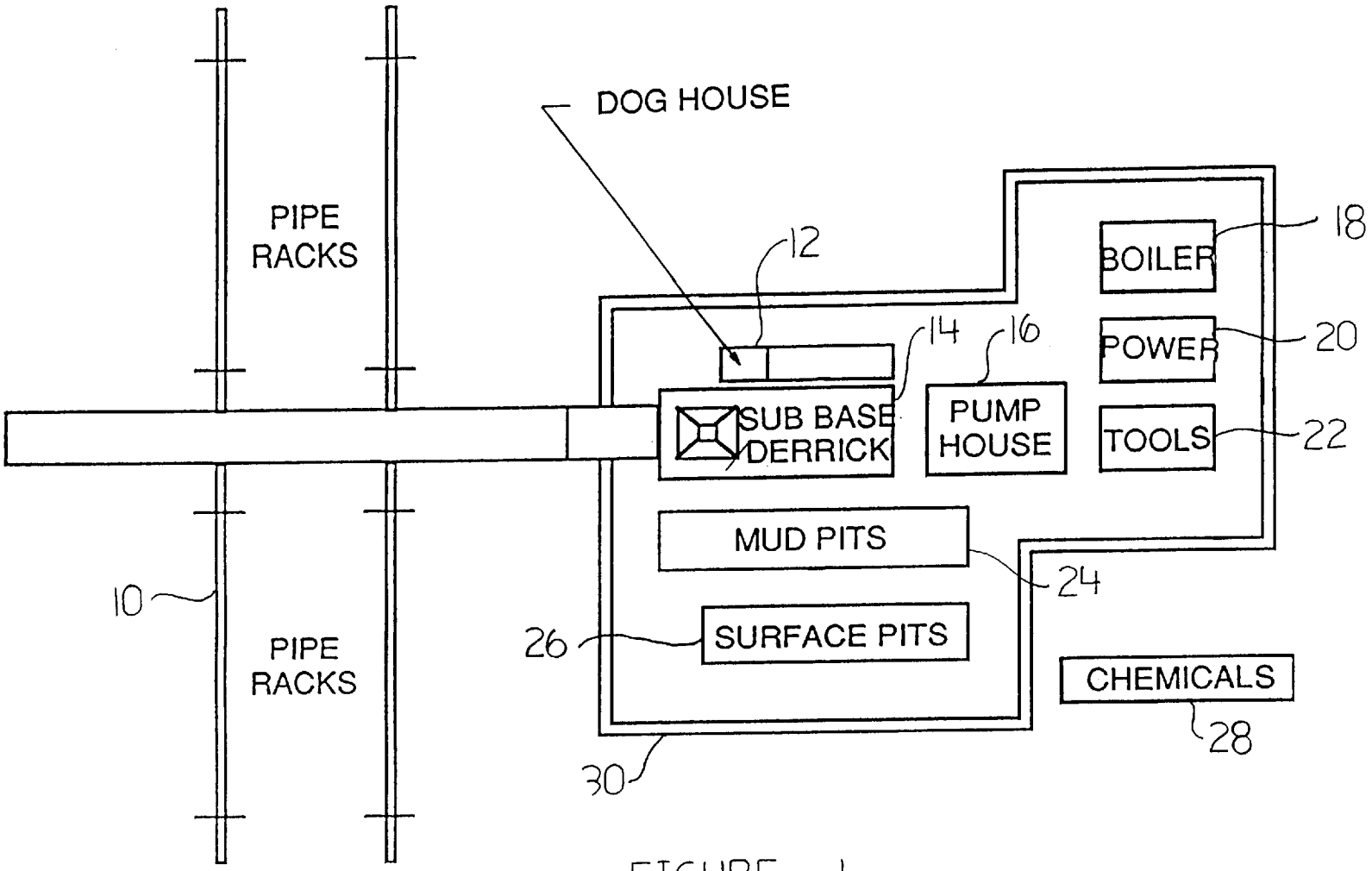
FIG. 1 is a schematic plan of a typical oil well site with associated equipment.

Referring to FIG. 1, a typical oil well site includes pipe racks 10, dog house 12, sub-base and derrick 14, pump house 16, boiler 18, power plant 20, tool house 22, mud pits 24, surface pits 26, and chemical storage trailer 28. A berm 30 is typically built around the site to contain spills. The mud pits 24 and surface pits 26 usually have a clay or plastic lining, and require dispersal at the completion of drilling.

Figure 2:
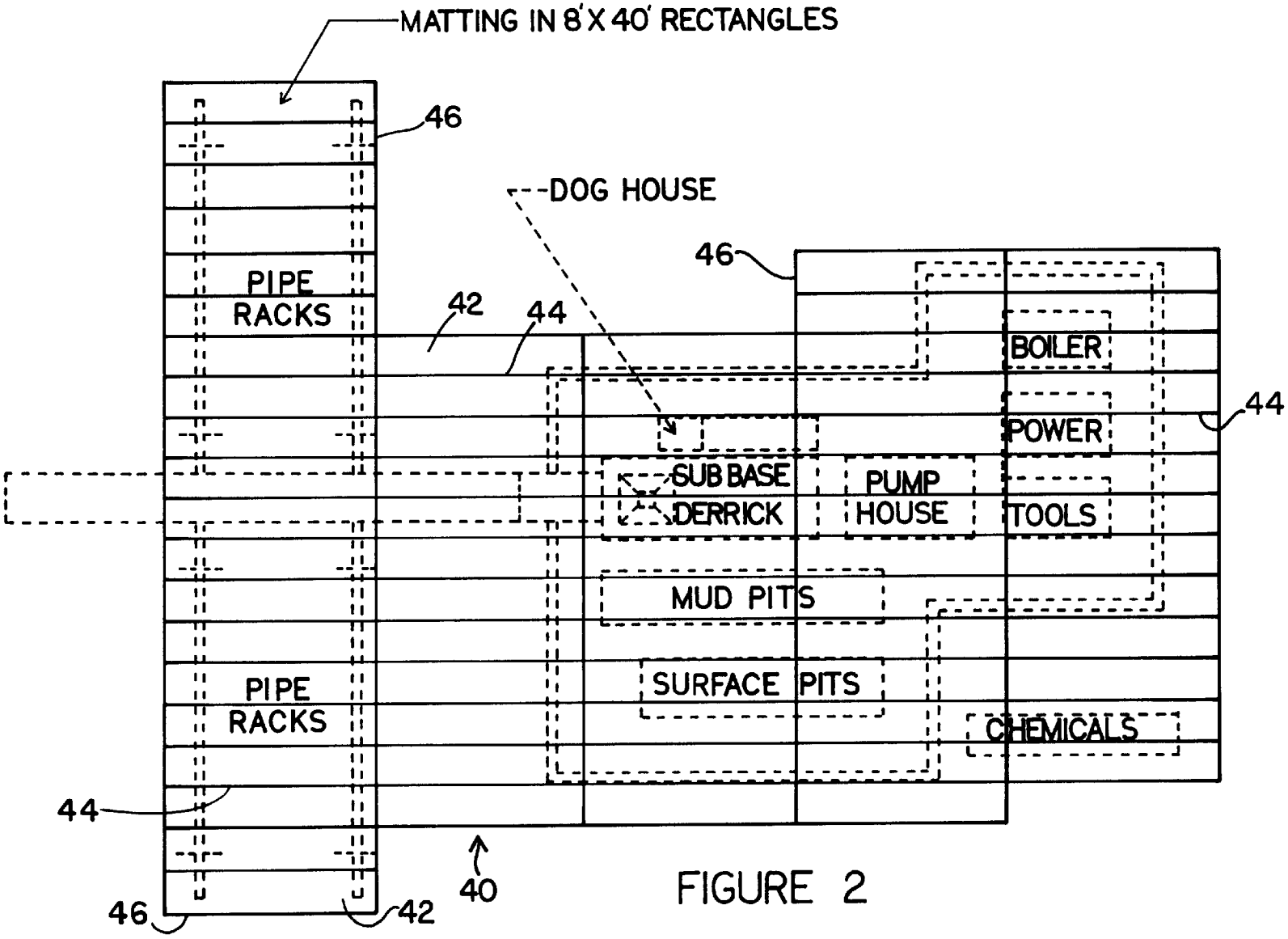
FIG. 2 is a plan view of an embodiment of the invention configured for the oil well site of FIG. 1 including plural fluid impervious sheets forming a pan.

As shown in FIG. 2, the invention provides a pan 40 or extensive fluid barrier formed of plural fluid impervious sheets 42 joined together at their edges 44 and surrounded by a peripheral wall 46. Each fluid impervious sheet 42 is about 8 feet by 40 feet and rests directly on the ground, which is preferably prepared by making the ground relatively flat. The equipment shown in FIG. 1 all lies directly on top of the fluid impervious sheets 42 and surrounded by the wall 46. The fluid impervious sheets may be configured in any desirable space filling shape, such as rectangular.

Figure 3:
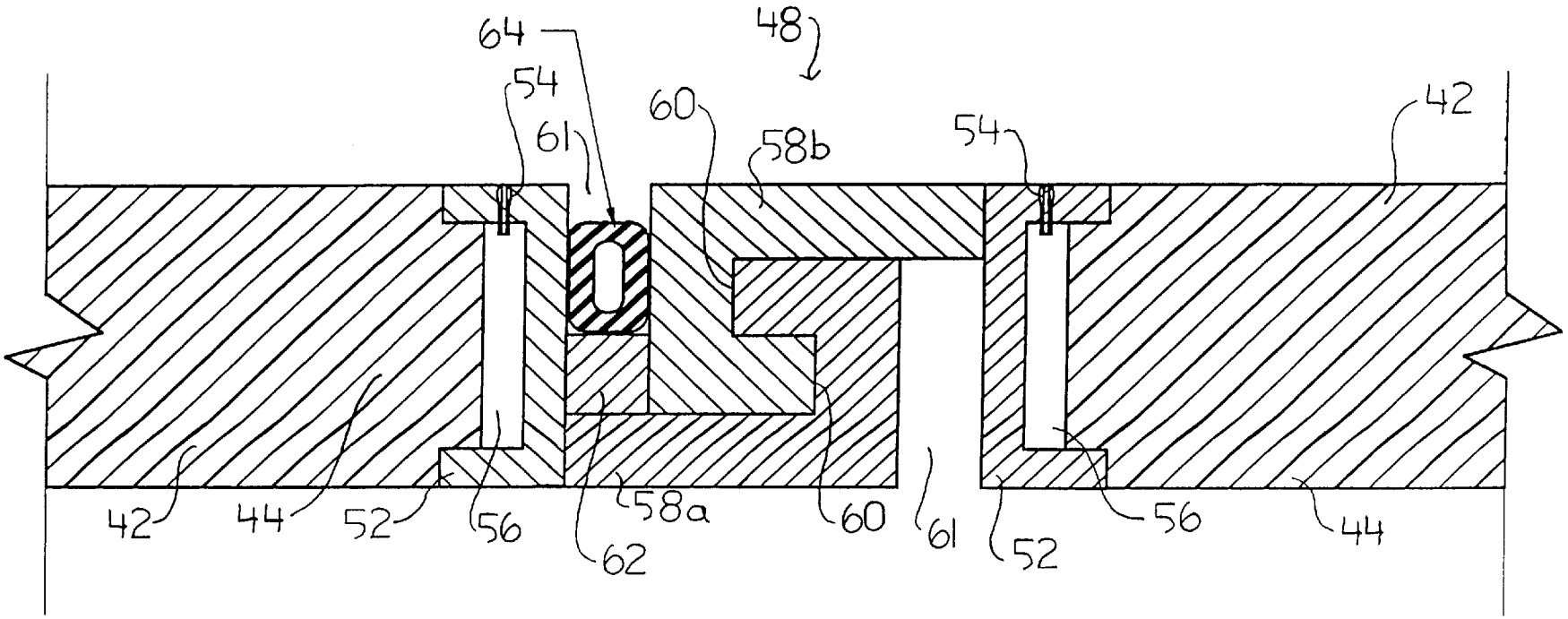
FIG. 3 is a cross-section of a seal for sealing adjacent fluid impervious sheets.

An exemplary seal 48 for joining adjacent fluid impervious sheets is shown in FIG. 3. Each fluid impervious sheet 42 has a peripheral edge 44 on which is compression fit a steel bracket 52. The steel bracket 52 encloses and extends along the peripheral edges of the fluid impervious sheet 42. The bracket 52 is sealed to the peripheral edge 44 of the fluid impervious sheet 42 by injection of sealant through nipple 54 into void 56 left between the C-shaped bracket 52 and the edge 44 of the fluid impervious sheet 42.

A hook shaped channel member 58*a* extends from the bracket 52 and has a terminal portion 60 spaced from the bracket 52 to allow interlocking of the hook shaped channel members of adjacent fluid impervious sheets as shown in FIG. 3. The hook shaped channel members 58*a* form sealable coupling members along each peripheral edge of the fluid impervious sheet 42. Each terminal portion 60 is spaced from the bracket 52 such that there is enough space 61 to fit both the hook shaped channel member 58*b* of an adjoining fluid impervious sheet 42 and a spacer 62 or other wedging element. Spacer 62 is preferably rigid, for example made of steel and holds the hook shaped channel members 58*a* and 58*b* interlocked to each other. An elongated rubber balloon 64 is also inserted into one of the spaces 61 between the top of the hook shaped channel member of one fluid impervious sheet and the bracket of an adjoining fluid impervious sheet. Spacer 62 and inflatable seal 64 may be secured together as for example by adhesive. The elongated rubber balloon or inflatable seal 64 is initially inserted deflated and may be inflated to force the hook shaped channel members 58*a* and 58*b* together and thus sealingly couple adjacent fluid impervious sheets 42 along their peripheral edges 44. The hook shaped channel member 58*a* may be referred to as a bottom hook shaped channel member and the hook shaped channel member 58*b* may be referred to as a top hook shaped channel member.

Figure 4:
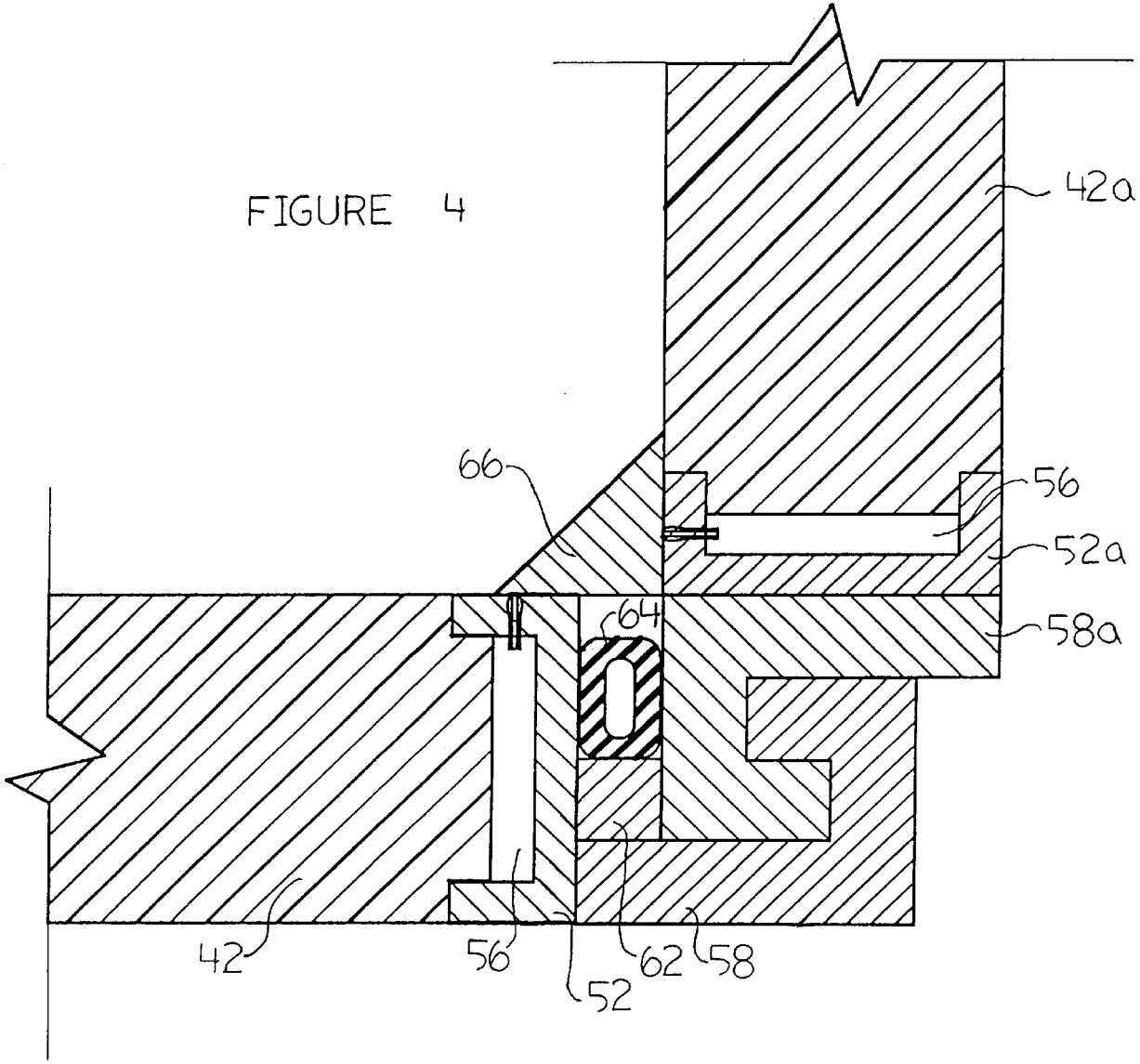
FIG. 4 is a cross-section of a seal for use at a wall for the pan of FIG. 2.

Around the perimeter of the pan 40 is a wall 46 as shown in FIG. 4. The wall 46 in this instance is made from a similar fluid impervious sheet 42*a*, whose bracket 52*a* lies transverse to the direction of the bracket 52 on fluid impervious sheet 42 in relation to the respective sheets. The hook shaped channel member 58*a* welded to bracket 52*a* lies parallel to the outer edge of the channel member 58*a*. Otherwise, channel member 58*a* is formed in the same manner as channel member 58. Likewise, spacer 62 and inflatable seal 64 are used to seal the wall 46 and fluid impervious sheet 42 together. An additional wedge 66 may be fastened at the joint between wall 46 and fluid impervious sheet 42 to support the wall 46. The wall 46 is thus sealingly coupled to, and may be uncoupled from, peripheral edges 44 of the fluid impervious sheets 42.

The fluid impervious sheets 42 are preferably made of plastic, laminated wood, or steel, with a sufficient compressive strength and thickness to withstand the weight of equipment to be placed on them. For example, the sheets may be laminated wood about 4 inches thick.

Figure 5:
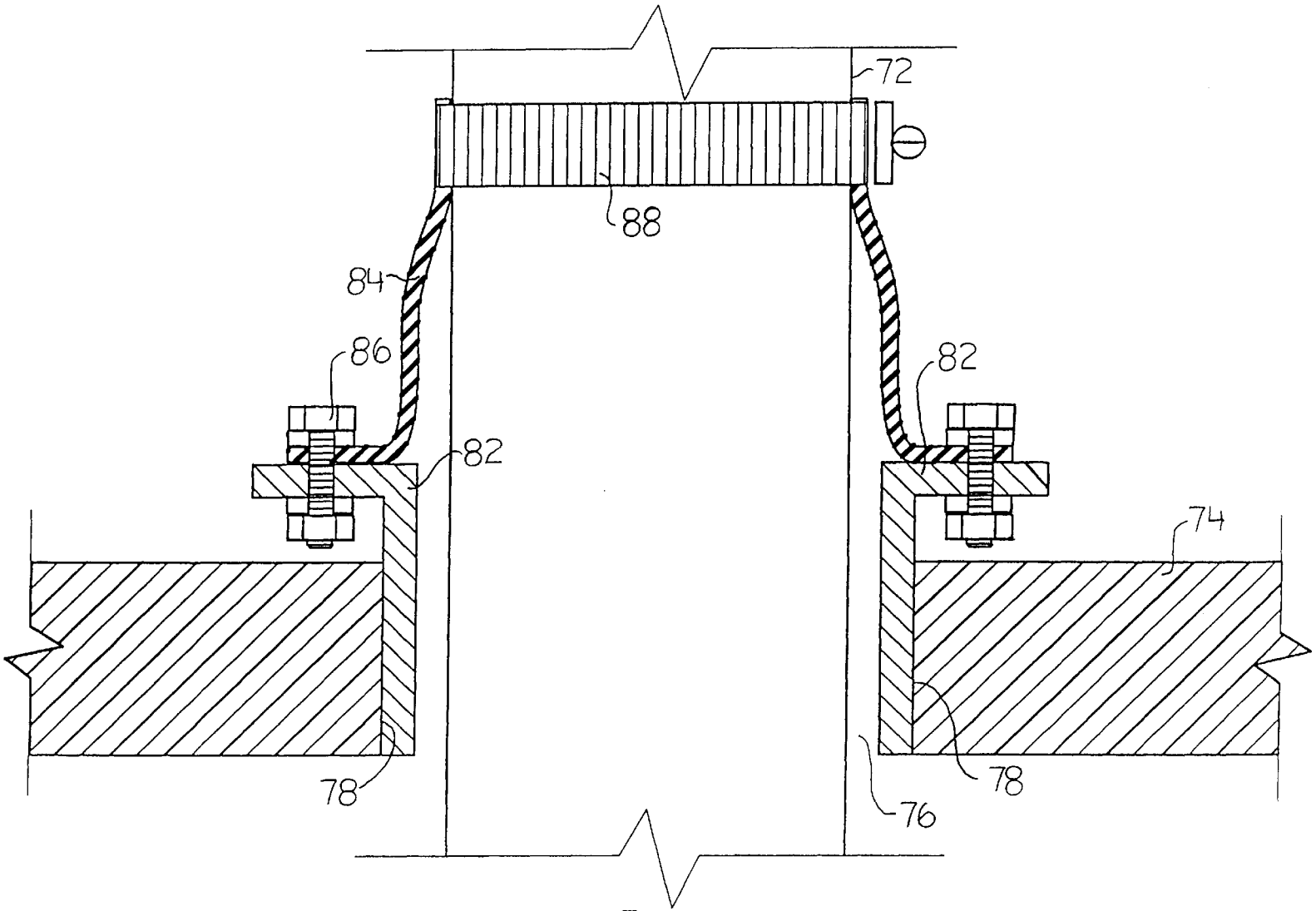
FIG. 5 is a cross-section of a seal for use at a pipe penetrating the pan of FIG. 2.
Figure 7:
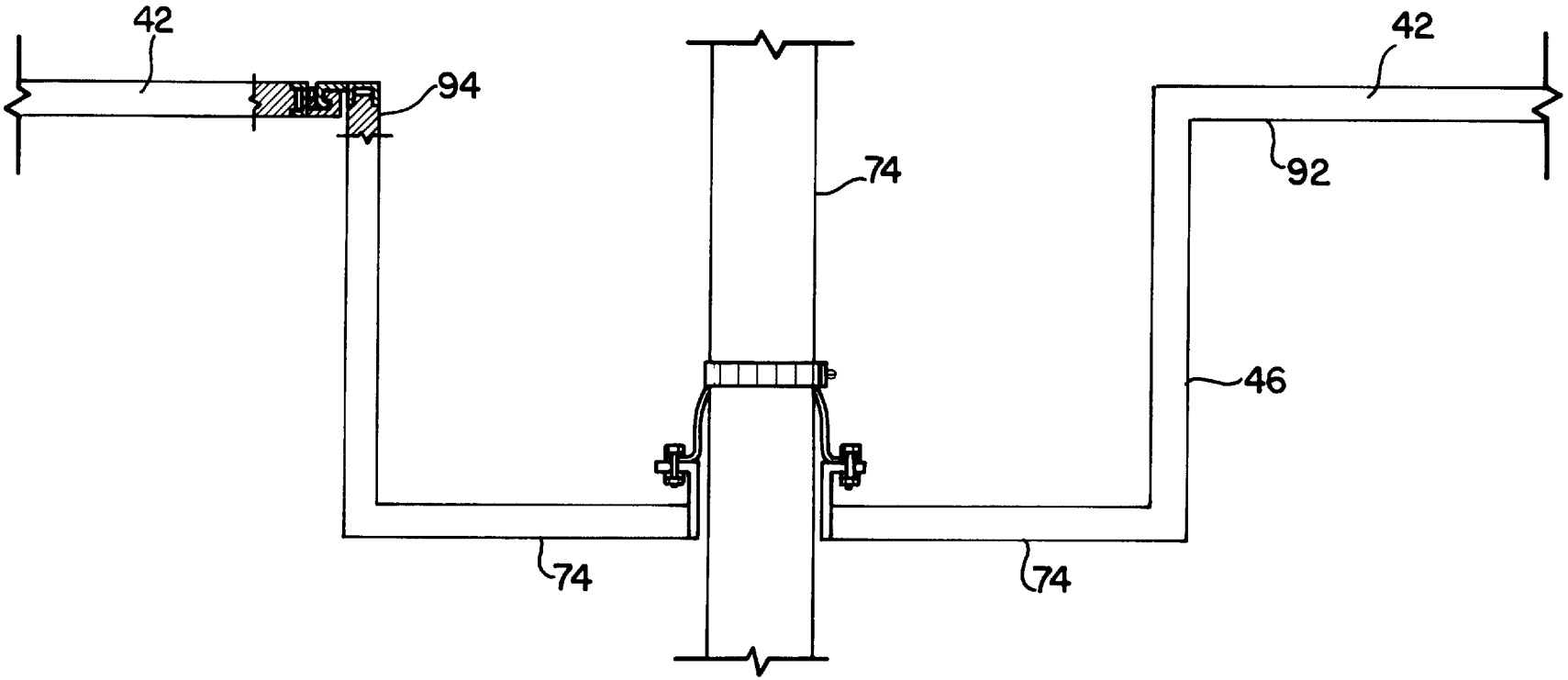
FIG. 7 is a cross-section of a sump for use at a pipe penetrating the pan of FIG. 2.
Figure 11:
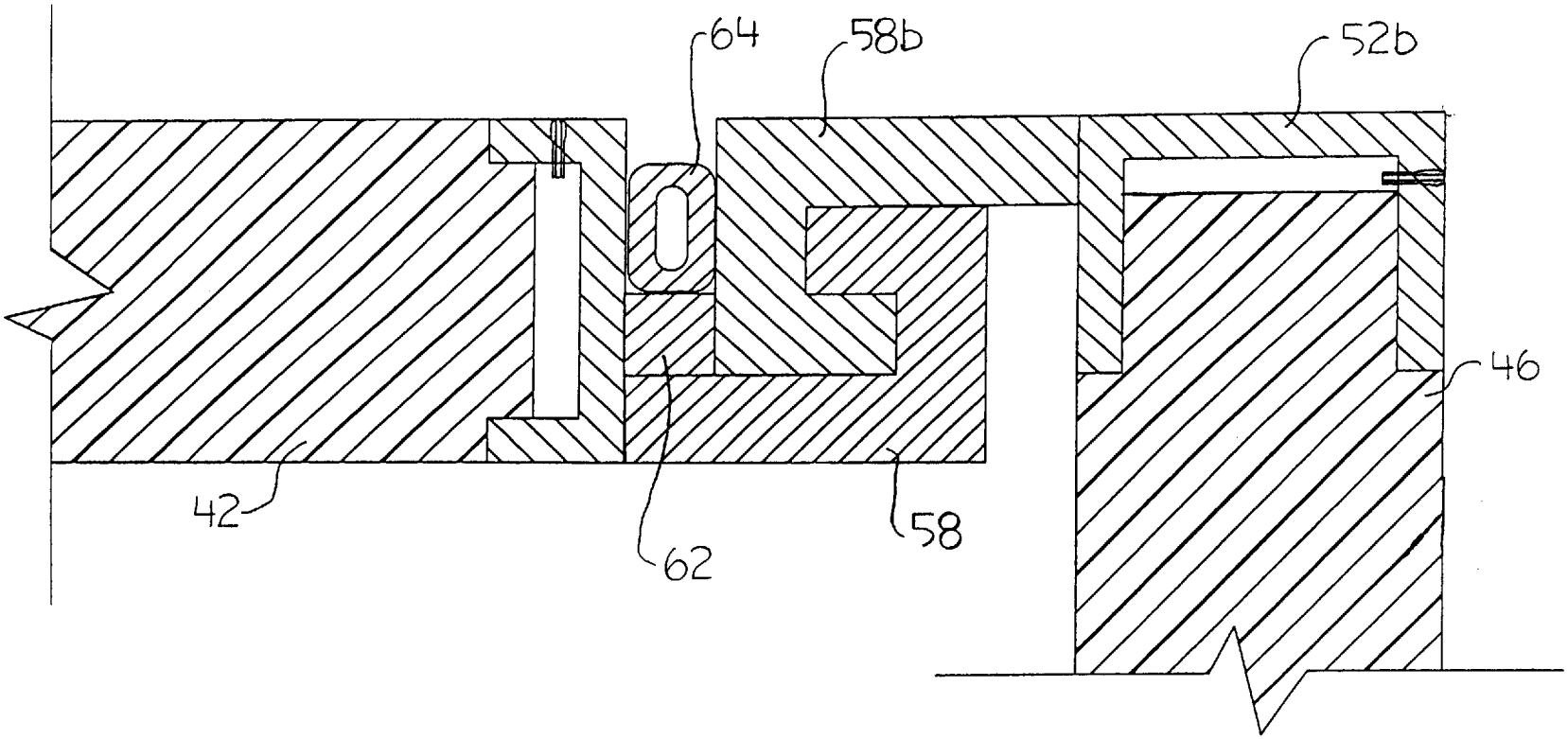
FIG. 11 is a cross-section of a down-going corner for use at the sump of FIG. 7.

Referring to FIG. 5, there is shown an embodiment for use where a pipe 72 penetrates a pan 40. Fluid impervious sheet 74 is the same as fluid impervious sheet 42 but has a square hole 76 cut in it. The edge 78 of the fluid impervious sheet 42 around the square hole 76 is fastened to an L-shaped bracket 82 forming a wall around the hole 76. A boot 84 is bolted to the bracket 82 as by bolts 86 and clamped to the pipe 72 by a clamp 88. As shown in FIG. 7, the sheet 74 may be depressed below the ground surface 92, and connected to surface fluid impervious sheets 42 by walls 46. A down going coupling 94 is illustrated in FIG. 11, wherein fluid impervious sheet 42, with hook shaped channel member 58 are made as shown in FIG. 3, and wall 46 terminates upwardly in a C-shaped bracket 52*b* with hook shaped channel member 58*b* extending laterally from the side of the C-shaped bracket 52*b*. Wedge element 62 and inflatable seal 64 complete the seal. The inflatable seal is hollow, sealed at the ends, and extends the length of the fluid impervious sheet.

Figure 6:
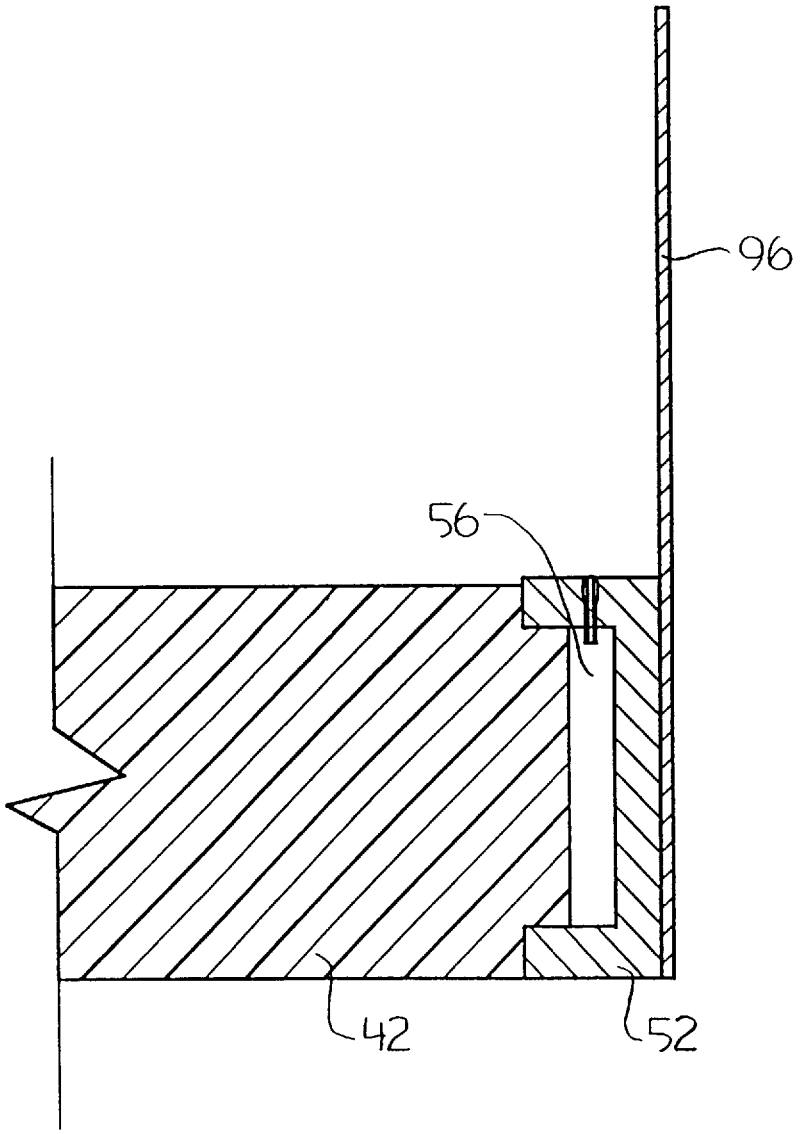
FIG. 6 is a cross-section of an embodiment of a wall for use in the pan of FIG. 2.

A second embodiment of a wall is shown in FIG. 6, in which a steel sheet 96 is fastened, as by bolting or welding, to a C-shaped channel member 52. The sheet 96 extends perpendicularly up from the fluid impervious sheet 42 and extends along at least one peripheral edge of the fluid impervious sheet. A fluid impervious sheet 42 for use at a corner of an oil well site pan may have walls on two sides, meeting at a corner.

Walls 46 of the type shown in FIG. 4 meeting at a corner of a fluid impervious sheet are connected by a connector 102 for example as shown in FIGS. 8A, 8B and 8C. The connector 102 is formed from a pair of upside down U-channel 102*a* and 102*b* joined together at right angles to form an L shape in plan view that fits over the top of the sheets forming the walls 46.

Figure 9:
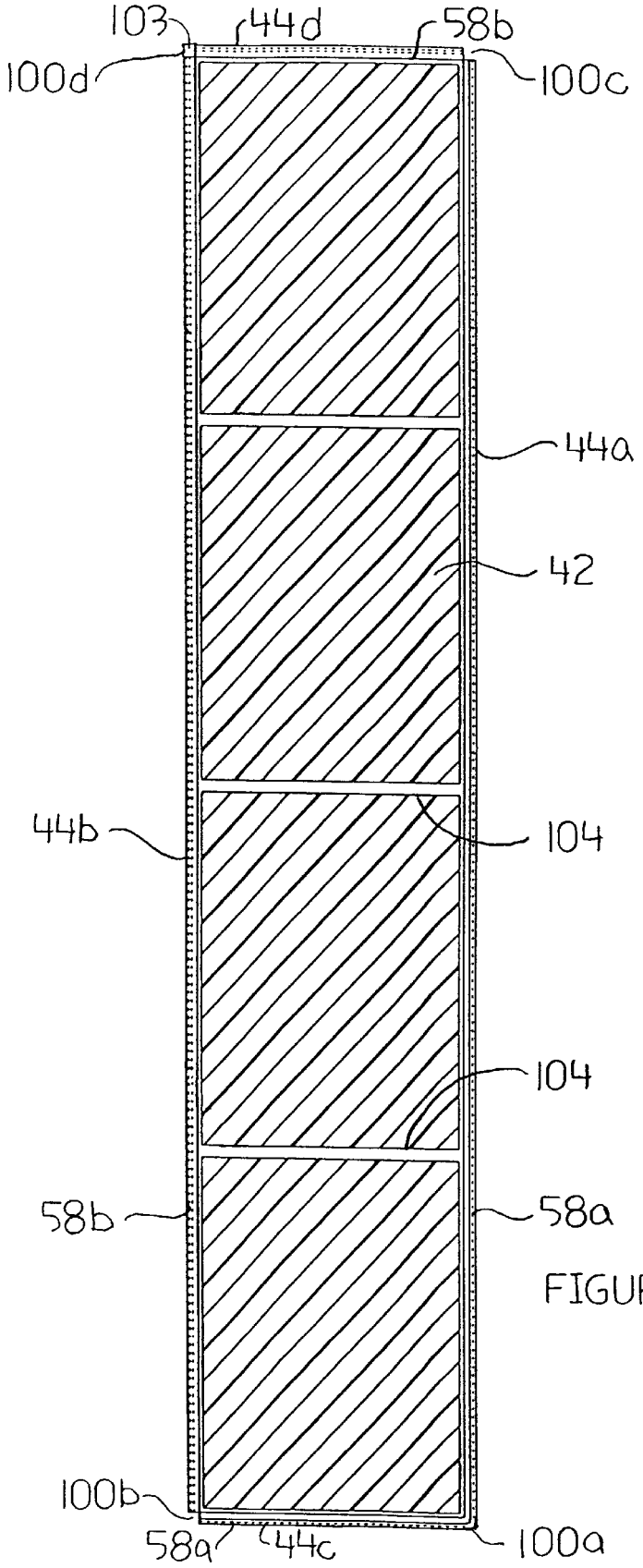
FIG. 9 is a top view of a fluid impervious sheet according to the invention showing re-enforcing bars.

As shown in FIG. 9, each fluid impervious sheet 42 is preferably reinforced along its length by longitudinally spaced reinforced bars 104 that are fastened to and interconnect C-shaped brackets 52 on opposite edges 44 of the fluid impervious sheets 42. Each fluid impervious sheet 42 is configured in the manner shown in FIG. 9 so that they can be area filling. Edges 44*a* and 44*c* have bottom hook shaped channel members 58*a*, in which the hook opens upward, and edges 44*b* and 44*d* have top hook shaped channel members in which the hook opens downward. At the bottom right corner 100*a*, the respective bottom hook shaped channel members 58*a* join together. At the bottom left corner 100*b* and the top right corner 100*c*, a bottom hook shaped channel member 58*a* and top hook shaped channel member 58*b* come close together, but do not extend beyond the C-shaped member 52 defining the edge of the sheet 42. At the top left corner 100*d*, the corner is filled with an extension 103 of the top hook shaped channel members 58*b* that form the edges 44*b* and 44*d*. This extension does not have hooks, but is just is a continuation of the metal of the top of the top hook shaped channel members 58*b*. The corners 100*a* and 100*d* form a pair of opposed corners, and the corners 100*b* and 100*c* also form a pair of opposed corners.

Figure 10:
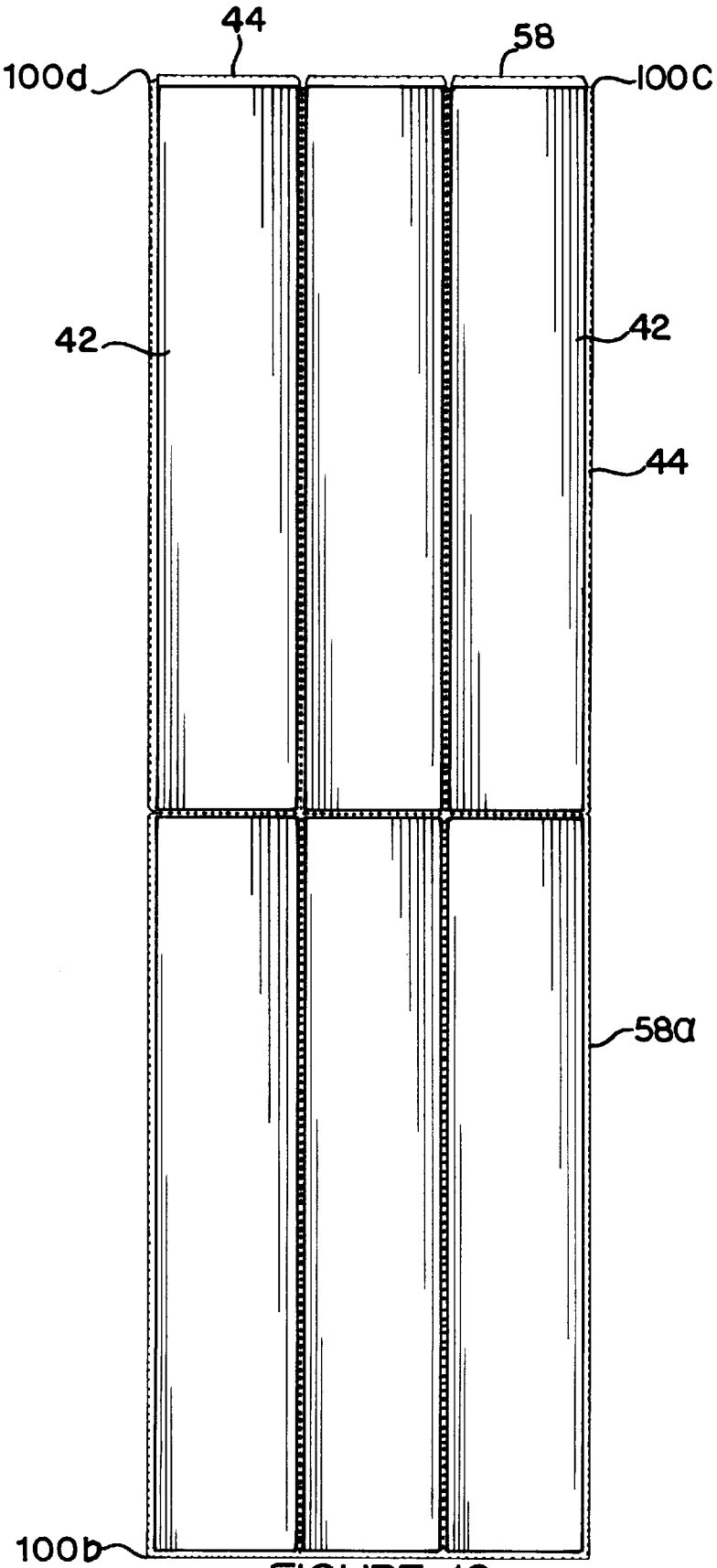
FIG. 10 is a top view of fluid impervious sheets according to the invention.
Figure 10A:
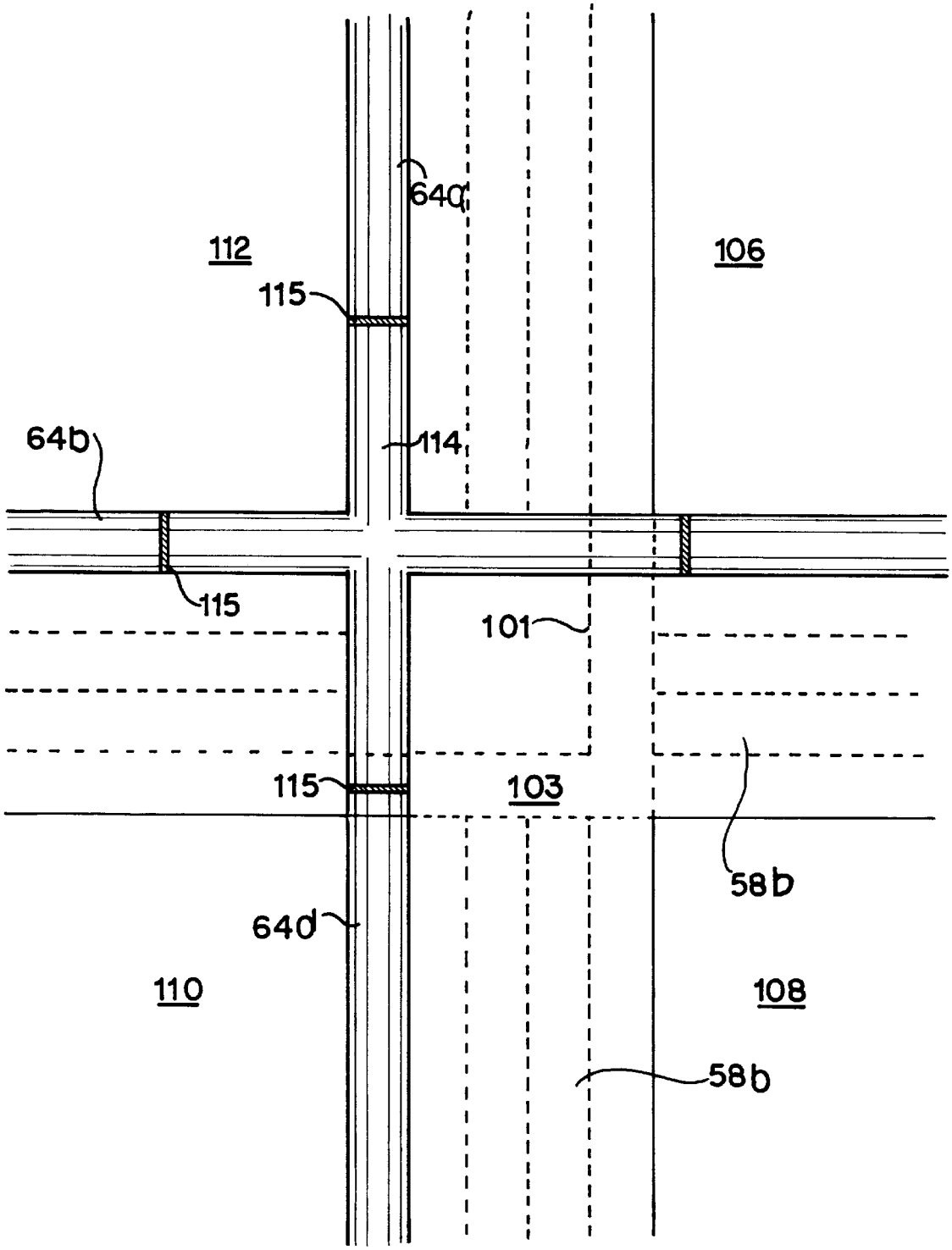

A set of six adjoining fluid impervious sheets according to the invention are shown in FIG. 10. Each sheet is formed according to the fluid impervious sheet shown in FIG. 9. The material of corner 100*d* overlies material of corner 100*a*. A detail of one of the corners where four sheets meet is shown in FIG. 10A. Thus, as shown in FIG. 10*a*, fluid impervious sheets 108 and 112 extend into the gap formed at the corner between the sheets. Extension 103 of the top hook shaped channel members 58*b* of fluid impervious sheet 108 overlies the continuation of the bottom hook shaped channel members 58*a* of fluid impervious sheet 112 into corner 100*a*.

The joint formed between four fluid impervious sheets 106, 108, 110 and 112 is sealed by a cross-shaped inflatable seal 114. This seal is hollow like inflatable seal 64 and joined to inflatable seals 64*a*, 64*b*, 64*c* and 64*d*. Seals 64*a*, 64*b*, 64*c* and 64*d* seal respectively fluid impervious sheets 106 and 112, fluid impervious sheets 110 and 112, fluid impervious sheets 106 and 108 and fluid impervious sheets 108 and 110. The joint between the inflatable seal 114 and inflatable seals 64*a*, 64*b*, 64*c* and 64*d* may be made by overlapping the inflatable seals and gluing them together as shown at 115.

Figure 17:
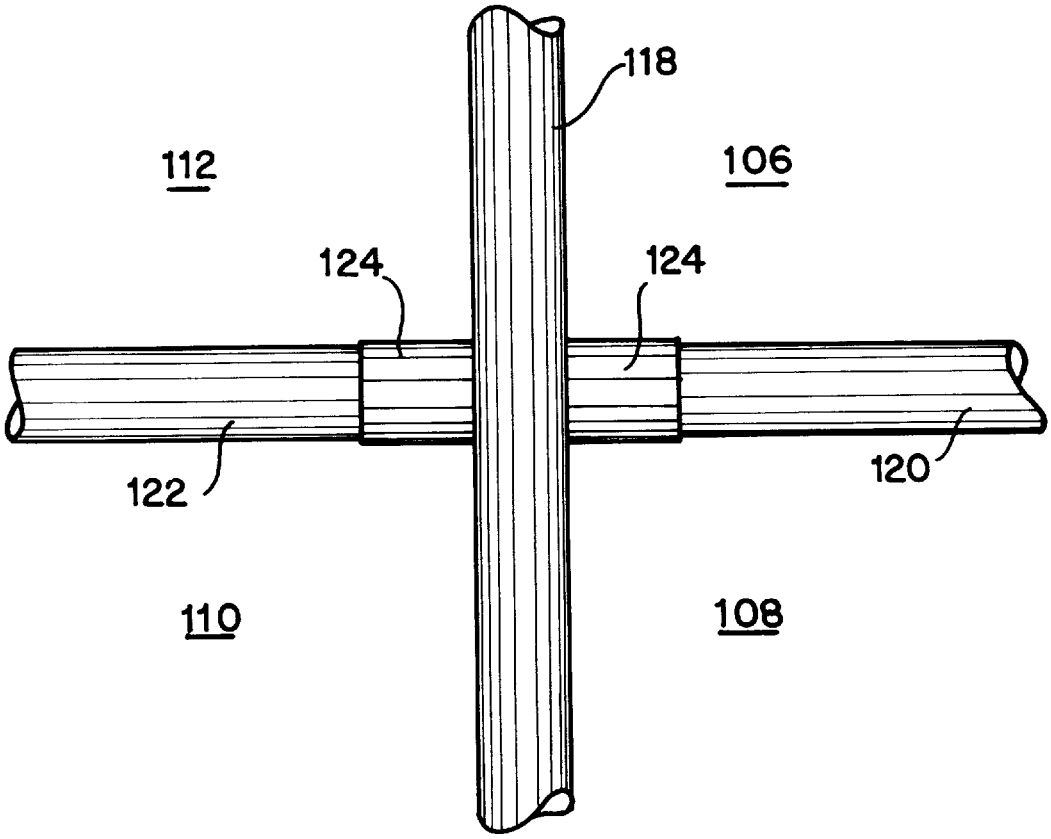
FIG. 17 is top view of an alternative seal for a corner where several fluid impervious sheets meet.
Figure 18:
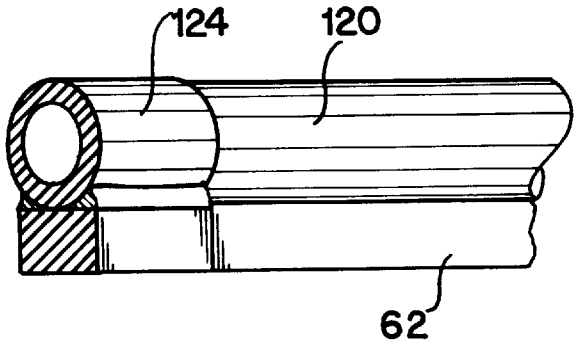
FIG. 18 is a side perspective view of the seal of FIG. 17.

An alternative form of seal for the corners between fluid impervious sheets is shown in FIGS. 17 and 18. An extended inflatable seal 118 extends along the joint between fluid impervious sheets 106 and 112 and fluid impervious sheets 108 and 110. This inflatable seal 118 may extend the full length of pan 40. A pair of inflatable seals 120 and 122 butt up to the inflatable seal 118 to form a cross. Butt joints 124 are formed of self moulding rubber sleeves that are attached to the ends of the inflatable seals 120 and 122. The butt joints 124, when inflated, push up against inflatable seal 118 to form a seal. One of the inflatable seals 120, rather than both, may be used for butting up against inflatable seal 118 at a wall. The inflatable seals 118, 120 and 122, like the inflatable seal 64, may be adhered to the spacer 62 as shown in FIG. 18.

Figure 12:
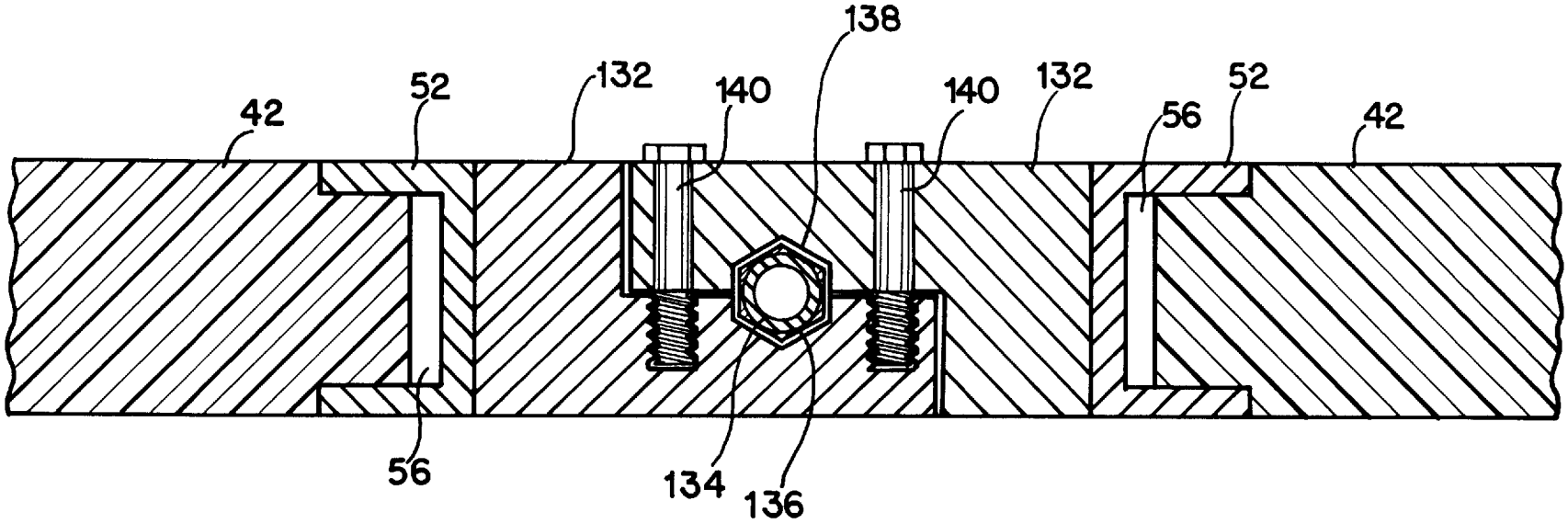
FIG. 12 is a cross-section of a second embodiment of a seal for use with the pan of FIG. 2.
Figure 13:
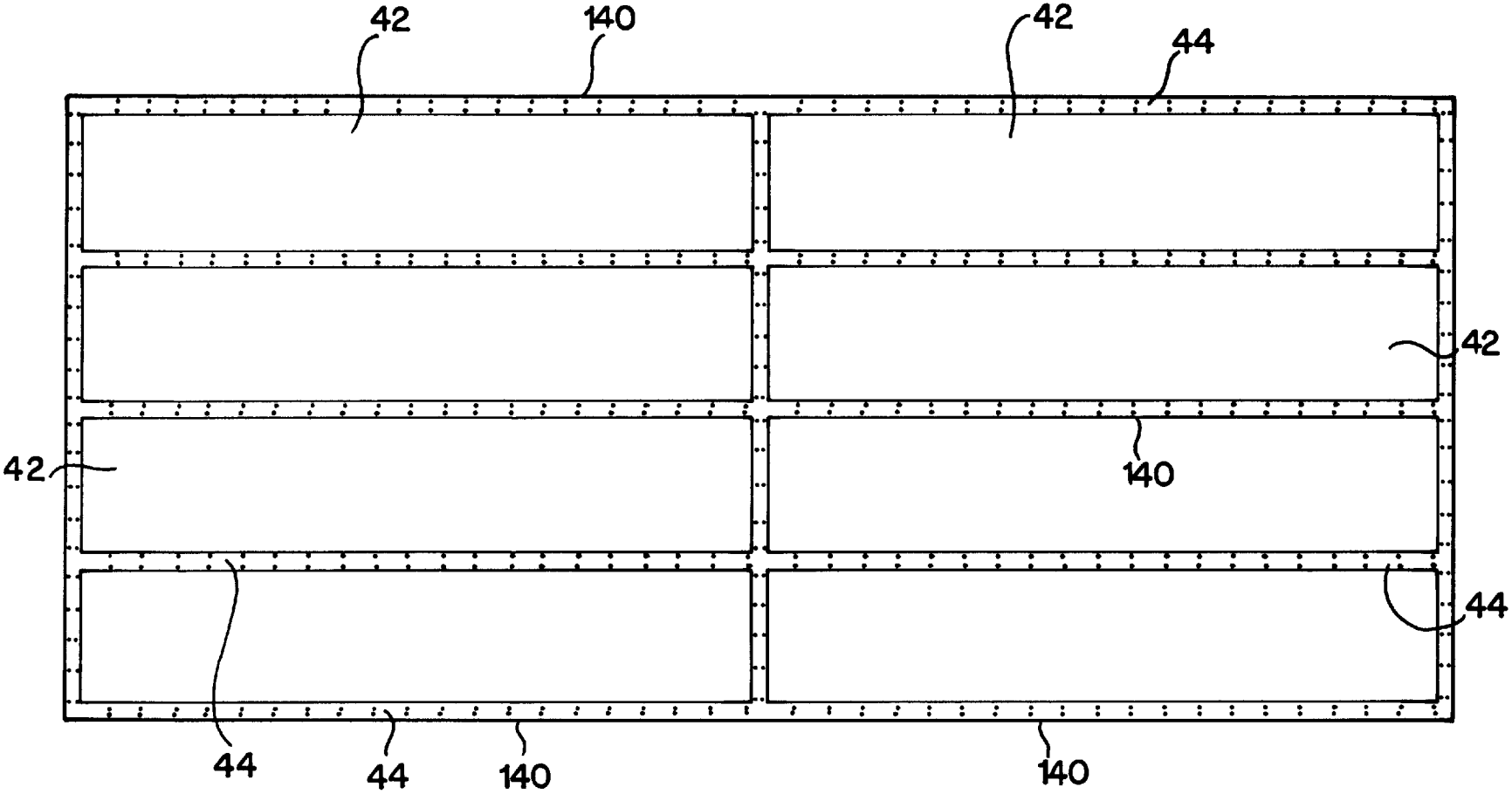
FIG. 13 is a top view of plural fluid impervious sheets with the seal of FIG. 12.

FIG. 12 shows an alternative form of sealing arrangement for the edges of a fluid impervious sheet. Fluid impervious sheets 42 are the same as in FIG. 3, and likewise sealed C-shaped brackets 52. In this embodiment, the sealing elements are formed of L-shaped members 132 welded or fastened by other means to the C-shaped brackets 52 along the edges 44 of the fluid impervious sheets 42. A seal between the L-shaped members 132 is formed by a steel tube 134 encased in a rubber sleeve 136 that fits in grooves 138 in each of the L-shaped members 132. Bolts 140 compress the L-shaped members 132 together and thus compress the rubber sleeve 136 to form a seal. FIG. 13 shows the seal system of FIG. 12 with the bolts 140 spaced along the peripheral edges 44 of the fluid impervious sheets 42.

Figure 14:
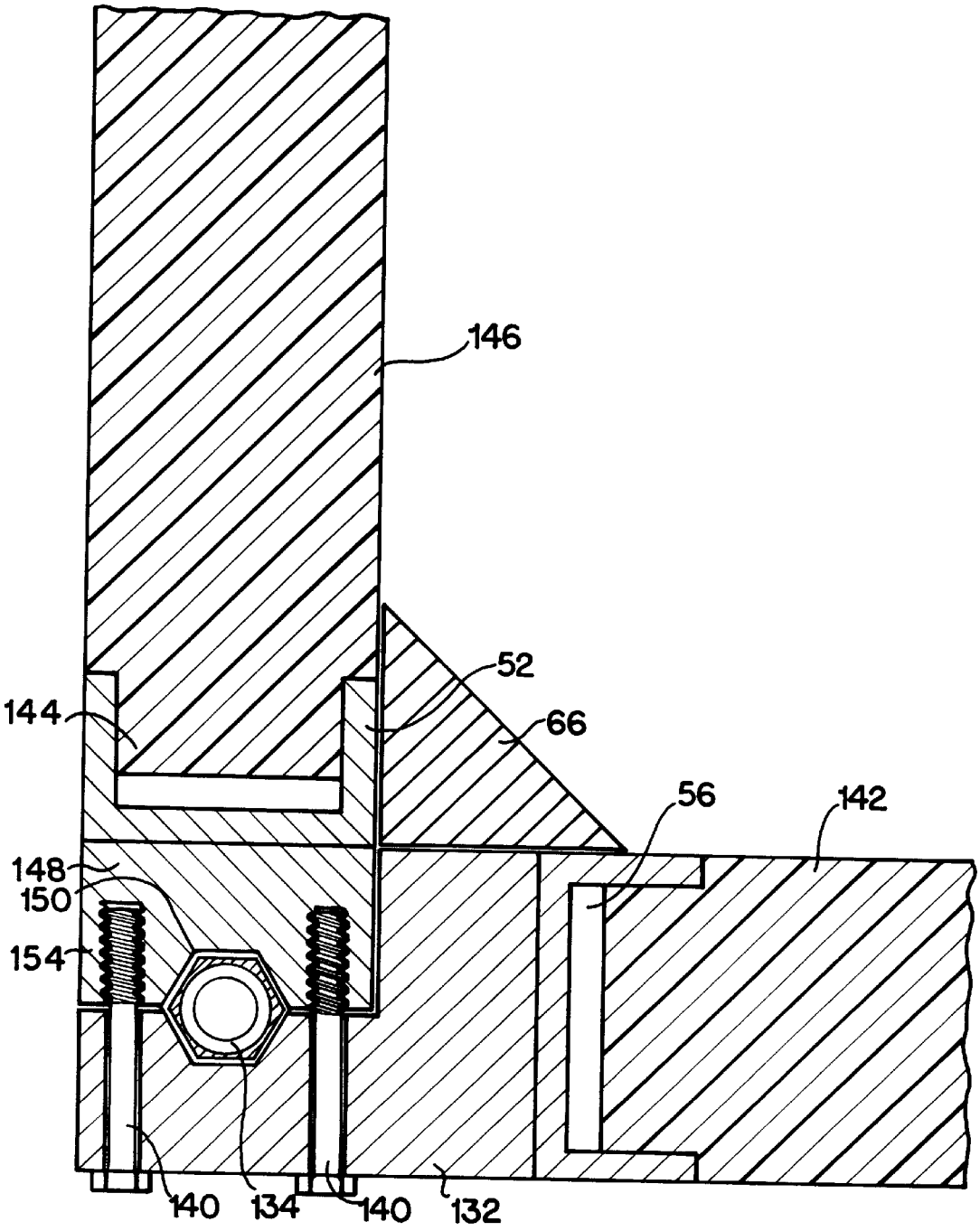
FIG. 14 is a cross-section of a wall for the pan of FIG. 2 with the sealing system of FIG. 12.

A wall 46 for the a pan with the seal of FIG. 12 is shown in FIG. 14. Fluid impervious sheet 142 with L-shaped member 132 is made as shown in FIG. 12. A wall fluid impervious sheet 146 is edged by a C-shaped bracket 52, fastened in like manner to the sheet as bracket 52 of FIG. 3 was fastened to sheet 42, and has a bar 148 running along the peripheral edges 144 of sheet 142. Bar 148 has threaded holes 154 for receiving bolts 140 and recess 150 for receiving rubber encased tube 134. Tightening of bolts 140 seals the wall 146 to fluid impervious sheet 142.

Figure 15:
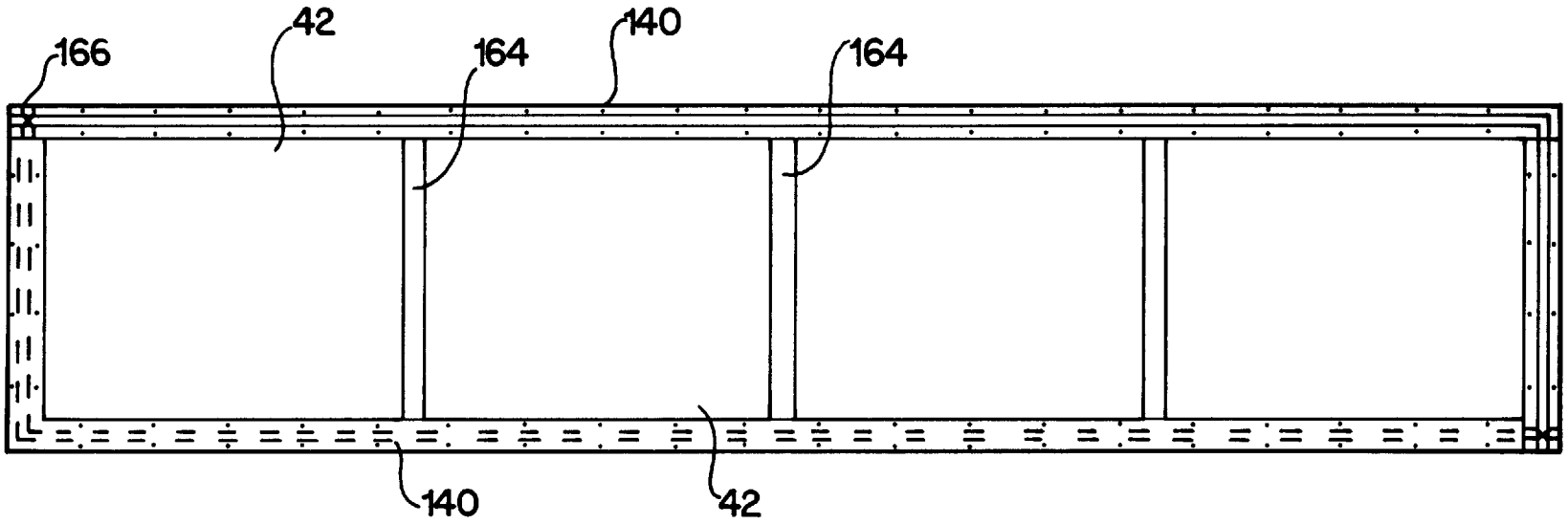
FIG. 15 is a top view of a fluid impervious sheet with the sealing perimeter of FIG. 12 and with re-enforcing bars.
Figure 16:
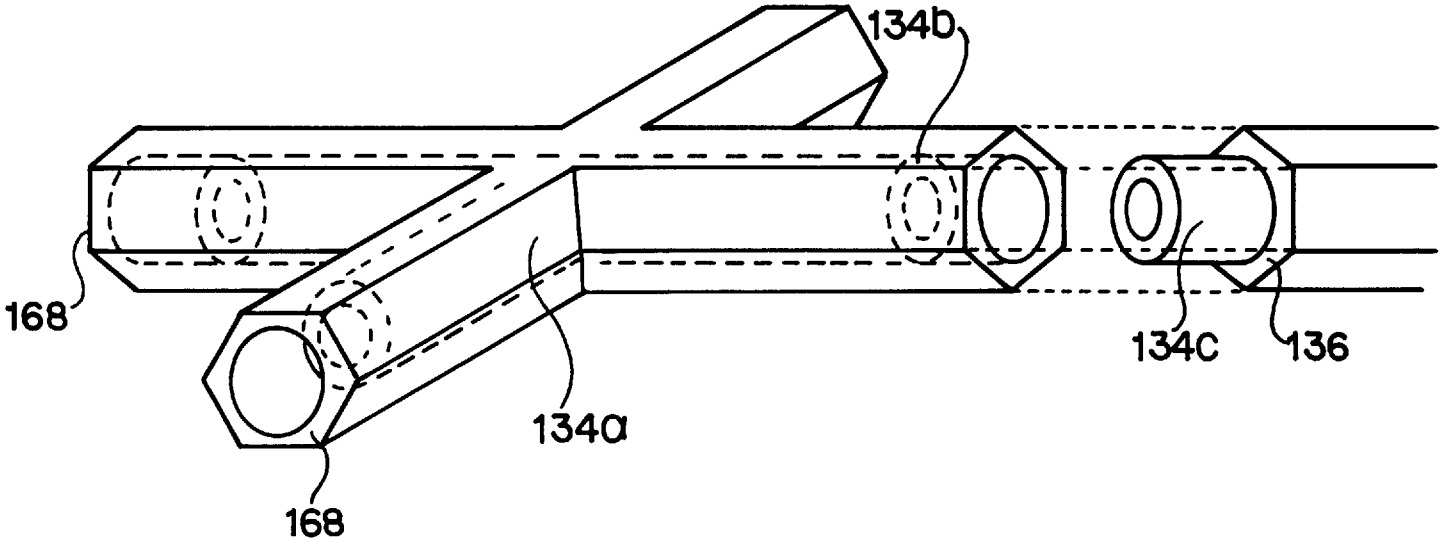
FIG. 16 is a detail showing the corner of the fluid impervious sheet of FIG. 15.

FIG. 15 shows a fluid impervious sheet 42 with the sealing system of FIG. 12, and re-enforcing bars 164 similar to re-enforcing bars 104 of FIG. 12. FIG. 16 shows an edge coupler for a corner 166 of one of the sheets 42. The rubber encased tubes 134*a* and 134*b* of respective edges meeting at a corner cross each other. The ends of the tubes 134*a* and 134*b* may terminate short of their laminate rubber coverings to form hollow receiving ends 168. The end of a sealing tube 134*c* lying along the length of one of the sides of the sheet 42 may extend beyond its laminated rubber covering 136, to form a male connection that may be received by one of the hollow receiving ends 168.

The modular sheets may be pinned or keyed in one or more places to prevent them from moving relative to adjacent sheets once the sheets are interlocked.

A person skilled in the art could make immaterial modifications to the invention described in this patent without departing from the essence of the invention.

The emodiments of the invention in which an exclusive property or priviledge is claimed are defined as follows:

1. A spill containment system comprising;

plural fluid impervious sheets, each sheet having peripheral edges;

coupling members along each of the peripheral edges of each sheet, the coupling members being adapted to sealingly couple to, and uncouple from, coupling members on the peripheral edges of each other sheet; and plural wall elements, each wall element having an edge adapted to sealingly couple to, and uncouple from, peripheral edges of the fluid impervious sheets, with the plural wall elements extending transversely to the fluid impervious sheets away from the peripheral edges of fluid impervious sheets, whereby the fluid impervious sheets and the wall elements may be sealed together to form a pan like structure having a peripheral wall for the containment of fluid within the pan like structure.

2. The spill containment system of claim 1 in which the sheets are sufficiently thick to support the weight of oil well site equipment.

3. The spill containment system of claim 1 in which the plural fluid impervious sheets are sealed together to form a base for an oil well site.

4. The spill containment system of claim 3 in which the plural fluid impervious sheets are supported by a prepared surface.

5. The spill containment system of claim 1 in which the coupling members of a sheet have the same construction around each of the peripheral edges of the sheet.

6. A spill containment system comprising:

plural fluid impervious sheets, each sheet having peripheral edges;

a bracket enclosing and scaled to each of the peripheral edges of the plural fluid impervious sheets;

a hook shaped channel member extending from each of said brackets, said hook shaped channel members having a terminal portion spaced from the brackets to allow interlocking of hook shaped channel members to the adjacent fluid impervious sheets; and plural wall elements, each wall element having an edge adapted to scalingly couple to, and uncouple from, peripheral edges of the fluid impervious sheets, whereby the fluid impervious sheets and the wall elements may be sealed together to form a pan like structure.

7. The spill containment system of claim 6 in which the fluid impervious sheets are sealed together to form a modular pan and further including wedging elements wedged between a hook shaped channel member of a first fluid impervious sheet and a bracket of an adjacent fluid impervious sheet.

8. The spill containment system of claim 7 in which the wedging elements include inflatable seals.

9. The spill containment system of claim 7 in which adjacent fluid impervious sheets meeting at a corner are sealed by cross-shaped seals.

10. An impervious sheet module for use in a fluid barrier, the impervious sheet module comprising;

a fluid impervious sheet having peripheral edges and corners between the peripheral edges; and each of the peripheral edges of the sheet including a sealable coupling member sealed to the sheet, the sealable coupling member extending continuously along the peripheral edges of the sheet between the corners of the sheet;

the sealable coupling member forming in cross-section a hook shape complimentary to itself;

the sealable coupling member including a hook shaped channel member formed of a first portion extending parallel to the fluid impervious sheet, a second portion extending transversely to the fluid impervious sheet and a terminal portion extending from the second portion towards the fluid impervious sheet, the terminal portion being spaced from the fluid impervious sheet; and the terminal portion being shorter than the spacing between the terminal portion and the fluid impervious sheet to allow interlocking of hook shaped channel members of adjacent fluid impervious sheets by motion transverse to the peripheral edge along which the coupling member extends.

11. The spill containment system of claim 10 in which each scalable coupling member on the peripheral edges of the fluid impervious sheet includes:

a bracket enclosing and sealed to the peripheral edge of the fluid impervious sheet; and the hook shaped channel member extending from the bracket, the hook shaped channel member being space from the bracket to allow interlocking of hook shaped channel members of adjacent fluid impervious sheets.

12. An impervious sheet module for use in a fluid barrier, the impervious sheet module comprising:

a fluid impervious sheet having peripheral edges and two pairs of opposed corners;

each of the peripheral edges of the sheet including a sealable coupling member sealed to the sheet, the sealable coupling member extending continuously along the peripheral edges of the sheet between adjacent corners of the sheet;

the sealable coupling members extending into each corner of only one of the pairs of corners and including means to sealingly couple the fluid impervious sheet to an adjacent fluid impervious sheet.

13. The impervious sheet module of claim 12 in which the sealable coupling member form in cross-section a hook shape complimentary to itself.

14. A method of forming a pan like structure for containing fluid spills, comprising the steps of:

sealingly coupling plural fluid impervious sheets along peripheral edges of the fluid impervious sheets using coupling elements that may couple and uncouple by motion transverse to the edges of the fluid impervious sheets to form a fluid impervious barrier; and sealingly coupling plural wall elements to peripheral edges of the fluid impervious sheets with the plural wall elements extending transversely to the fluid impervious sheets away from the peripheral edges of the fluid impervious sheets for form a pan like structure having a peripheral wall for the containment of fluid within the pan like structure.

15. A spill containment system comprising:

Plural fluid impervious sheets, each sheet having peripheral edges;

a plurality of coupling members for attachment to the peripheral edges of each sheet, said coupling members being adapted to sealingly couple to and uncouple from coupling members on the peripheral edges of each other sheet; and means for sealingly attaching the coupling members to the peripheral edges of each sheet; and plural wall elements, each wall element having an edge adapted to sealingly couple to, and uncouple from, peripheral edges of the fluid impervious sheets with the plural wall elements extending transversely to the fluid impervious sheets away from the peripheral edges of the fluid impervious sheets, whereby the fluid impervious sheets and the wall elements may be sealed together to form a pan-like structure having a peripheral wall for the containment of fluid within the pan-like structure.

* * * * *